US009884712B2

(12) United States Patent
Coogan et al.

(10) Patent No.: US 9,884,712 B2
(45) Date of Patent: Feb. 6, 2018

(54) BOTTLE IN BOX CONTAINER AND BLANK

(71) Applicants: George Coogan, Signal Mountain, TN (US); Jason Ray, Westfield, IN (US); Stokes Smith, Signal Mountain, TN (US); Bill Jones, Chattanooga, TN (US); Ron Couvillon, Whitwell, TN (US)

(72) Inventors: George Coogan, Signal Mountain, TN (US); Jason Ray, Westfield, IN (US); Stokes Smith, Signal Mountain, TN (US); Bill Jones, Chattanooga, TN (US); Ron Couvillon, Whitwell, TN (US)

(73) Assignee: Southern Champion Tray, L.P., Chattanooga, TN (US)

( * ) Notice: Subject to any disclaimer, the term of this patent is extended or adjusted under 35 U.S.C. 154(b) by 0 days.

(21) Appl. No.: 15/237,599

(22) Filed: Aug. 15, 2016

(65) Prior Publication Data

US 2017/0036837 A1 Feb. 9, 2017

Related U.S. Application Data

(63) Continuation of application No. 14/327,037, filed on Jul. 9, 2014, now Pat. No. 9,415,997, and a (Continued)

(51) Int. Cl.

| | |
|---|---|
| ***B65D 5/46*** | (2006.01) |
| ***B65D 5/468*** | (2006.01) |
| ***B65D 77/04*** | (2006.01) |
| ***B67D 7/84*** | (2010.01) |
| ***B67D 3/00*** | (2006.01) |
| ***B65B 3/02*** | (2006.01) |

(Continued)

(52) U.S. Cl.

CPC ..... *B65D 77/0426* (2013.01); *B65B 3/025* (2013.01); *B65D 5/008* (2013.01); *B65D 5/4608* (2013.01); *B65D 5/46088* (2013.01); *B65D 5/746* (2013.01); *B65D 77/065* (2013.01); *B67D 3/0051* (2013.01); *B67D 7/84* (2013.01); *B31B 50/734* (2017.08); *B31B 50/81* (2017.08); *B31B 2100/00* (2017.08); *B31B 2120/00* (2017.08); *B31B 2120/25* (2017.08)

(58) Field of Classification Search

CPC B65D 5/008; B65D 5/46088; B65D 77/0426; B65D 77/065; B65D 5/4608; B65D 5/46192; B65D 77/0413; B65D 77/062; B67D 7/84; B67D 3/0051; B65B 3/025

USPC ..... 229/117.3, 117.35, 125.15, 125.04, 229/117.27, 113, 117.16, 117.13; 220/495.05, 495.03, 495.06, 62.21, 23.91, 220/592.16, 903; 222/325, 92; 383/906, 383/66; 493/87, 93, 907

See application file for complete search history.

(56) References Cited

U.S. PATENT DOCUMENTS 3,233,817 A * 2/1966 Casady ..... B65D 77/065 222/105

5,048,691 A * 9/1991 Heuberger ..... B65D 77/065 229/117.22

(Continued)

*Primary Examiner* — Christopher Demeree

(74) *Attorney, Agent, or Firm* — Miller & Martin PLLC

(57) ABSTRACT

An improved container blank of foldable material and resulting structure to hold a fluid filled carton is provided.

20 Claims, 15 Drawing Sheets

Related U.S. Application Data continuation-in-part of application No. 13/457,483, filed on Apr. 26, 2012, now abandoned.

(60) Provisional application No. 61/479,339, filed on Apr. 26, 2011.

(51) Int. Cl.

| | |
|---|---|
| ***B65D 77/06*** | (2006.01) |
| ***B65D 5/00*** | (2006.01) |
| ***B65D 5/74*** | (2006.01) |
| *B31B 50/81* | (2017.01) |
| *B31B 100/00* | (2017.01) |
| *B31B 120/25* | (2017.01) |
| *B31B 50/73* | (2017.01) |
| *B31B 120/00* | (2017.01) |

(56) References Cited

U.S. PATENT DOCUMENTS 5,199,594 A * 4/1993 Obara ..... B65D 31/12 229/117.3
5,482,179 A * 1/1996 Bruhn ..... B65D 77/062 220/668
5,715,992 A * 2/1998 Andrews, Sr. ..... B65D 5/46104 229/104
5,829,637 A * 11/1998 Takemura ..... B65D 5/603 222/105
6,053,401 A * 4/2000 Andrews, Sr. ..... B65D 77/065 220/495.03
6,228,011 B1 * 5/2001 Takemura ..... B65D 5/603 220/495.03
6,253,993 B1 * 7/2001 Lloyd ..... B65D 5/2047 229/112
6,519,436 B2 * 2/2003 Katsuyama ..... B65D 77/06 229/117.27
6,648,218 B2 * 11/2003 Katsuyama et al. ..... G03G 15/0874 220/495.06
8,276,806 B2 * 10/2012 Burke ..... B65D 77/062 222/92
8,627,999 B2 * 1/2014 Wolf ..... B65D 5/029 229/117.15
2004/0089672 A1 * 5/2004 Crosland ..... B65D 5/10 222/105
2005/0017011 A1 * 1/2005 Andrews, Sr. ..... B65D 5/46104 220/495.06
2005/0023330 A1 * 2/2005 Cook ..... B65D 77/067 229/117.3
2005/0211754 A1 * 9/2005 Fulcher ..... B65D 5/46024 229/117.3
2006/0097005 A1 * 5/2006 Hill ..... B65D 5/10 222/105
2011/0253774 A1 * 10/2011 Hill ..... B65D 5/46112 229/117.3
2011/0259916 A1 * 10/2011 Spivey, Sr. ..... B65D 5/4208 222/105

* cited by examiner

BOTTLE IN BOX CONTAINER AND BLANK

The present application is a continuation of U.S. Ser. No. 14/327,037 filed Jul. 9, 2014, which is a continuation-in-part of U.S. Ser. No. 13/457,483, filed Apr. 26, 2012, which claims priority to U.S. Provisional Ser. No. 61/479,339, filed Apr. 26, 2011.

FIELD OF THE INVENTION

This invention relates to an improved beverage container a foldable blank. More specifically, this invention is directed to an improved easily fillable container for storing, transporting, and dispensing beverages.

BACKGROUND OF THE INVENTION

In the development of beverage packaging, numerous attempts have been made to provide paperboard packaging for fluids, utilizing a plastic bag within the paperboard structure to hold the fluid. As these packages evolved to have dispensing spouts secured and extending from the paperboard packaging, many issues have been addressed, including the secure mounting of spouts and the design of spouts that were easy to use. It has also been desirable to make the inner pouches of these containers removable so that plastic and cardboard or paperboard material can be recycled separately after use. As the bag in box packaging has evolved, some packaging has been designed for the particular use of conveying hot or cold liquids and maintaining an appropriate serving temperature. For instance, a coffee shop or restaurant might utilize a paperboard and plastic bag in box style carton in lieu of a returnable thermos to allow customers to carry multiple servings of branded coffee for use at meetings at location remote from the retail shop dispensing the beverage. Similarly, a restaurant may provide soup in a paperboard and plastic bag in box container.

Most of these containers have provided a paperboard outer shell with an opening for a spout on a front vertical panel or forward directed angled panel. When the opening is on the front vertical panel, in order to fill the bag, the container is rested on its back. In these designs, a handle, if any, protrudes from the top of the paperboard box. Paperboard bag in boxes have been shipped to customers in three general fashions. In one fashion the box is shipped as a paperboard blank to be folded and assembled with the plastic bag at the retail location. In a second form, the components are shipped and the assembly requires the use of adhesives. In a third form, the bag is inserted into an assembled box which is collapsed and shipped to the retail location where it need only be expanded to its full size by unfolding. The use of unassembled paperboard blanks is not entirely satisfactory since retail establishment employees must be trained to the proper assembly of the box and bag structure. Heretofore, the collapsed assembled boxes have also suffered from shortcomings in that the handle structures have not been sturdy and the box must necessarily be placed in different orientations for filling, pouring, and resting positions. The need to use a variety of orientations for the box can make it impractical to fill the box with liquid to a point approaching the actual volume of the container. The use of a plastic carton or bottle in a pre-assembled box avoids some of the shortcomings, and although it does not provide the space saving features of using collapsed blanks and bags, it is economical and resolves many other operational difficulties.

Accordingly, it would be desirable to provide a new bottle in box structure to address one or more of these shortcomings to provide additional benefits to retailers and consumers.

SUMMARY OF THE INVENTION

Accordingly, a plurality of improved beverage containers are disclosed in this specification of the type having an outer paperboard shell, a spout securing portion, and a handle or gripping structure. When the handle is built into a sidewall of the paperboard container, or openings are provided in the paperboard container to allow use of a handle on a bottle therein, an insulating panel is provided to keep the users hand from contacting the plastic bag of liquid, or carton of liquid, which may be uncomfortably hot to touch. The improved beverage containers preferably rest upon a bottom or base, and have an upward opening spout so that the containers may be filled in the same position that the containers are placed when not in use. A structure is also provided to securely hold the spout of the plastic bag or carton so that it does not fall downward into the surrounding box structure and the fastener for the spout may be easily detached for filling or pouring, and secured when the container is at rest or not in use.

A variation of the container may allow for protruding handles. The containers may also be pre-assembled and delivered to retail locations in their ready to use configuration. For this purpose, the paperboard blanks may simply be assembled with their associated plastic bags or cartons or they may be assembled and glued as necessary to maintain the assembled structure of a particular blank.

Once it has been determined that a preassembled container is acceptable to a customer, the interior fluid filled bag is preferably replaced with a non-collapsible plastic carton, most typically a HDPE bottle. This realizes cost savings, and the plastic carton provides additional rigidity to the assembled container. It may even allow the container to be carried by a handle formed as a part of the top, or by the cap of the plastic carton.

For the purpose of summarizing the invention and the advantages achieved over the prior art, certain objects and advantages of the invention have been described above. It is not necessary that all objects or advantages be achieved in accordance with any particular embodiment of the invention. Thus for example, those skilled in the art will recognize that the invention may be embodied or carried out in a manner that achieves or optimizes one advantage as taught herein without necessarily achieving other objects or advantages as may be taught or suggested herein.

BRIEF DESCRIPTION OF THE DRAWINGS

Turning then to the drawings, several embodiments of one or more aspects of the invention will be discussed in detail. The drawings depict exemplarily blanks and beverage containers for illustrative purposes only and include the following figures with like numerals indicating like parts.

DETAILED DESCRIPTION OF THE INVENTION

Figure 1B:
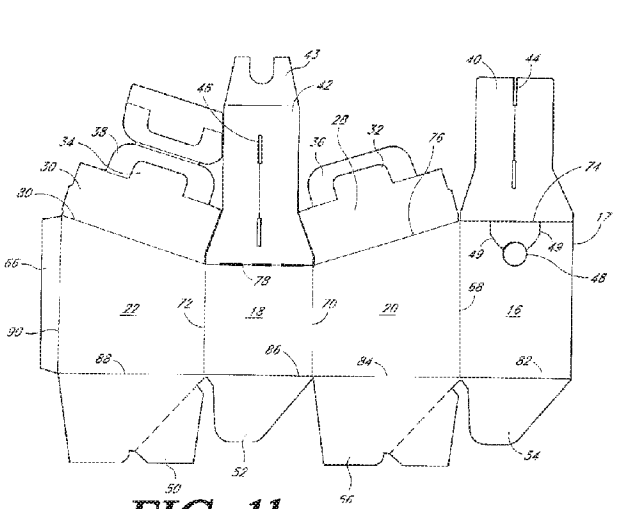
FIG. 1b (PRIOR ART)
FIG. 1*b* is a top plan view of a blank from which the outer shell of the container of FIG. 1*a* is manufactured, showing the side forming the exterior of the container.

To better appreciate the advantages of the preferred container, a prior art beverage container is shown in detail. FIGS. 1*a-d* illustrate a beverage container constructed in accordance with the teachings of the prior art. The beverage container 10 includes an outer container or shell 3, and an inner bag (not shown) having a mouth and a spout 9. The bag is positioned within the outer shell 3 and communicates with the exterior of the container 10 through the mouth and spout 9. The container 10 has a front 13, a back 15, a left side 17, a right side 19, a top 21 and a bottom 23. In addition, the container defines a handle 25.

Figure 1D:
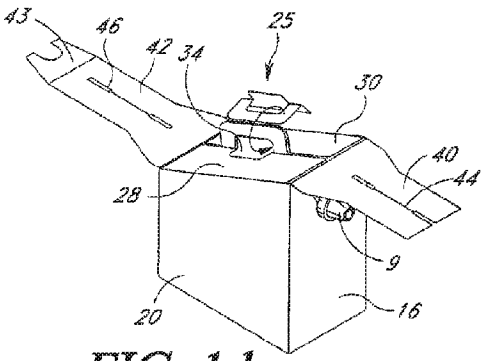
FIG. 1d (PRIOR ART)
FIG. 1*c* and 1*d* are perspective views illustrating steps in the assembly of the beverage container from the blank of FIG. 1*b*.
Figure 1A:
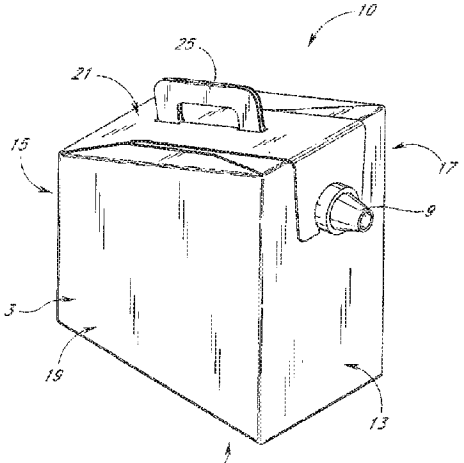
FIG. 1a (PRIOR ART)
FIG. 1*a* is a perspective view of a beverage container of the prior art.

As seen in FIG. 1*a*, the outer shell 3 is configured to be constructed from a one-piece cardboard blank. Of course, the outer shell 3 could be constructed of other materials, such as, for example, fluted or corrugated plastics, other non-corrugated plastics, or other foldable materials. The shell has a front wall panel 16, a back wall panel 18, a right side wall panel 20, a left side wall panel 22 and a side attachment tab 66. The front wall panel 16 defines a circular opening 48 and tapered slits 49. The front wall panel 16 is hingedly attached, such as by folding, along a right front fold line 68 to right side wall panel 20. Adjacent the right front fold line 68, the right side wall panel 20 is hingedly attached to the back wall panel 18 along a right back fold line 70. Opposite the right back fold line 70, the back wall panel 18 is hingedly attached to the left side wall panel 22 along a left back fold line 72. Adjacent the left back fold line 72, the attachment tab 66 is attached to the left wall panel 22 along a left front fold line 90, such as by an adhesive.

The blank further incorporates a series of top flaps and a series of bottom flaps. The top flaps include a top front flap 40, a top right handle flap 28, a top back flap 42 and a top left handle flap 30. The bottom flaps include a front bottom flap 54, right bottom flap 56, a back bottom flap 52 and a left bottom flap 50. The top front flap 40 is hingedly secured along a top front fold line 74 to the front wall panel 16. Likewise, the bottom front flap 54 is hingedly secured along a bottom front fold line 82 to the front wall panel 16. A circular opening 48 is formed within the front wall panel 16 in close proximity to the top front fold line 74. The top front flap 40 defines an open-ended slot 44 extending to a distal edge of top front flap 40.

The right side panel 20 is hingedly coupled along a top right fold line 76 to top right handle flap 28 and is also hingedly secured along a bottom right fold line 84 to a bottom right flap 56. The top right handle flap 28 includes a right handle portion 36 and a right tab portion 32.

Similar to the construction of the front wall panel 16, the back wall panel 18 hingedly carries a top back flap 42 and a bottom back flap 52 by respective fold lines 78, 86. The top back flap 42 includes a closed slot 46 and a generally U-shaped distal locking portion 43. A top left handle flap 30 extends from the left side wall panel 22 at top left fold line 80, while a bottom left flap 50 extends from the left side wall panel 22 from at bottom left fold line 88.

The top left handle flap 30 includes a double left handle portion 38 and a pair of left tab portions 34, 39 which are formed by cutouts to define an opening underneath the left handle portion 38. The bottom left flap 50 defines a small, generally semi-circular slit 75 which forms a finger flap 77.

The bag may be connected to the outer shell 3. The bag may have one or several layers of material exhibiting the desired characteristics of taste neutrality, thermal insulation and strength. The spout may be attached with adhesives or welding. The mouth has a generally cylindrical body with an annular outer rim at one end which is bonded to the bag, and external threads at the other end, to receive a screw on closure or spout. The opening of the mouth further defines a generally cylindrical internal channel into the bag. The mouth is advantageously sized and shaped for the external threads to be slightly larger than the opening 48 in the front wall panel 16 of the outer shell 3.

Preferably during manufacture and before shipping to an end user, the tab 66 of the left side wall panel 22 is fastened to the front wall panel 16 along an edge 17 of the front wall 16 opposite of the right front fold line 68. The fastening may be accomplished by double sided tape, adhesive, or other fastening means known to those of skill in the art. Upon fastening, the outer shell 3 may then be laid and stored flattened with two adjacent panels, such as panels 16 and 20 for example, facing upwards, and the other two side wall panels, panels 18 and 22, facing downwards. The outer shell is thus ready for quick assembly and may be stored in stacks. The spout 9 is threaded onto the mouth after the container has been filled.

The illustrated spout 9 of the container is conical in shape and is internally threaded to mate with the external threads of the mouth. For convenience, the mouth may include a tear-off portion for sealing the container, until the destination is reached. In an alternative embodiment, the spout may be omitted, and a cap may be provided to close the mouth, to reduce cost.

Figure 1C:
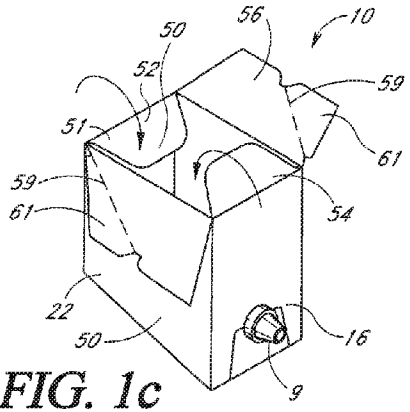
FIG. 1c (PRIOR ART)

FIG. 1*c* illustrates the assembly of the bottom of the outer shell 3. The wall panels 16, 18, 20, and 22, folded to form a substantially rectangular opening 55. The front wall panel 16 is folded along left front fold line 90 so that the front wall panel is perpendicular to the left side wall panel 22. The front wall panel 16 is also oriented perpendicularly with respect to right side wall panel 20 along right front fold line 68, so that left side wall panel 22 and right side wall panel 20 are parallel to each other. The back wall panel 18 is folded along the left back fold line 72 to be perpendicular to the left side wall panel 22, and is also folded along the right back fold line 70 to be perpendicular to the right side wall panel 20. The back wall panel 18 is thus parallel to the front wall panel 16. The side attachment tab 66 is affixed to the front wall 16.

The bottom front flap 54 and bottom back flap 52 are folded inwardly such that the flaps 54, 52 are perpendicular their respective wall panels 16, 18. The sidewall flaps 50, 56 are also folded inwardly. These sidewall flaps 50, 56 each have a fold line 59 thereby defining an adhering portion 61. The adhering portion is configured to adhere to the respective bottom front flap 54 and bottom back flap 52. This may be accomplished by placing an adhesive either on the adhering portion 61, or on the respective flap 54, 52. The adhesive may be any type of suitable adhesive such as moisture activated glue, or covered with a protective plastic sheet, or other type of adhesive such that the adhesive can be selectively activated to engage the adhering portions 61 with the flaps 52, 54. As such, a user activates the adhesive and folds the bottom flaps 50, 56 and tucks the adhering portions 61 under the opposing bottom flap 50, 56, such that the adhering portions 61 directly contact the underlying bottom front flap 54 and bottom back flap 52. The result is an outer shell having a secure bottom that maintains the outer shell in an erected configuration.

FIG. 1*d* illustrates the formation of the top and handle 25 of the outer shell 3. The top right handle flap 28, which is secured to right side wall panel 20 along top right fold line 76, is folded over across the rectangular opening so that the top right handle flap 28 is generally perpendicular to the right side wall 20 and the right handle portion 36 is folded upward from the top right handle flap 28 so that the right handle portion 36 is perpendicular to the top right handle flap 28.

The top left handle flap 30 is folded down and the left handle portion 38, which is also folded upright like the right handle portion 36, cooperates with right handle portion 36. The left handle portion tab 34, which is cutout from underneath the left handle portion 38 is placed through the opening underneath the right handle portion 36 and over the right tab 32. The left handle portion 38 is shown being folded over the right handle portion 36 and the distal tab 39 of the left handle portion 38 is slid under the proximal tab 34 of the left handle portion to form the handle 25 of the outer shell 3. Top front flap 40 is folded over along top front fold line 74 onto the top right handle flap 28 and the top left handle flap 30. The handle 25 is inserted through the open-ended slot 44, thereby allowing the top front flap 40 to rest flat against the right and left handle flaps 28 and 30. The top back flap 42 is folded over along top back fold line 78 onto the top front flap 40 and the top right and left handle flaps 28 and 30. The handle 25 is inserted through the slot 46 of the top back flap 42, allowing the top back flap 42 to rest flat against the top front flap 40 and the top right and left handle flaps 28 and 30. The distal locking portion 43 of the top back flap 42 is inserted into a groove formed by the body of the mouth of the flexible bag so that the locking portion prevents the mouth from being pulled back into the outer shell 3 by the weight of the liquid when filled. The top front flap 40 and the top back flap 42 lock the handle flaps 28, 30 in place. Thus assembled, the handle 25 extends away from the outer shell 3 and defines an opening sized and shaped to receive the fingers of a hand.

The mouth defines a flow channel having a diameter of about ¾ inches, or 1 inch, or 1¼ inches. Consequently, the typical user is able to visually determine when the level of fluid in the bag is close to the bottom of the mouth and can cut off the flow of fluid into the container 10. To operate effectively in this prior art design, the bag is sized such that when the level of fluid in the container is observed approaching the bottom of the mouth, the container is positioned with its back wall panel 18 faced downward in a fill position and when the container 10 is rotated to rest on its bottom 23 with the handle 25 facing up, in a transporting position, the level of fluid in the bag is preferably below the opening formed by the spout 9 or mouth, to reduce the risk of spilling during transport and the risk of injury to the user from spillage of hot coffee when the spout is opened. As a result, the container is used with a significant amount of empty space within the pyramidal structure.

Figure 2:
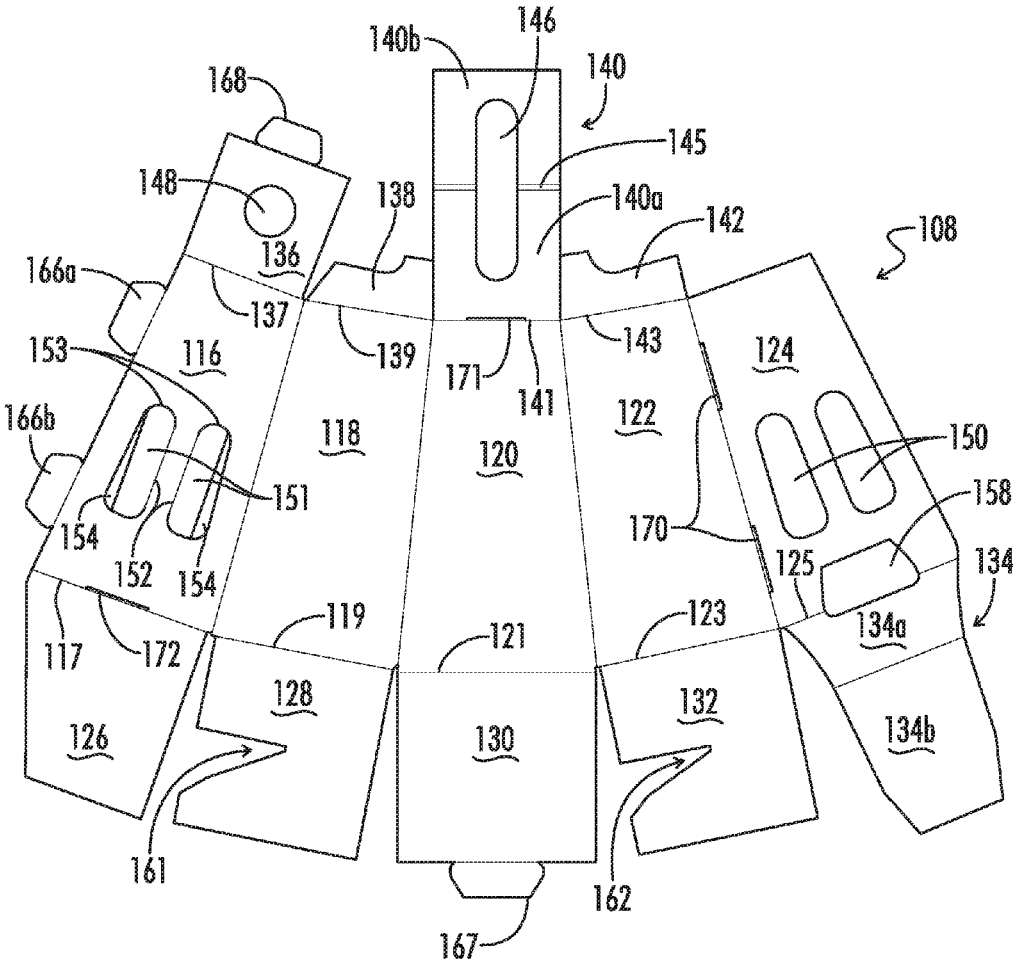
FIG. 2 is a bottom plan view of a blank from which an outer shell of an improved beverage container as manufactured, showing the side forming the interior of the container.
Figure 3A:
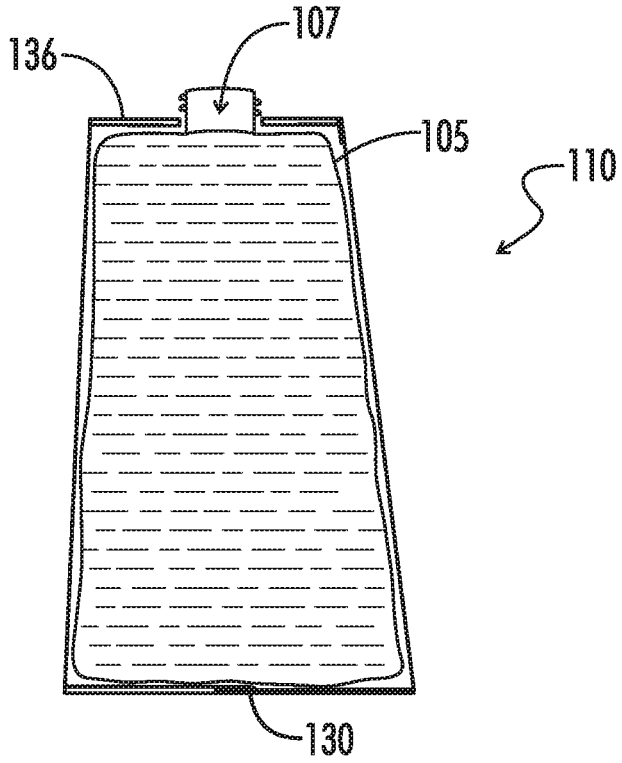
FIG. 3*a* is a sectional view of a beverage container constructed from the blank of FIG. 2 with a flexible bag secured therein.
Figure 3B:
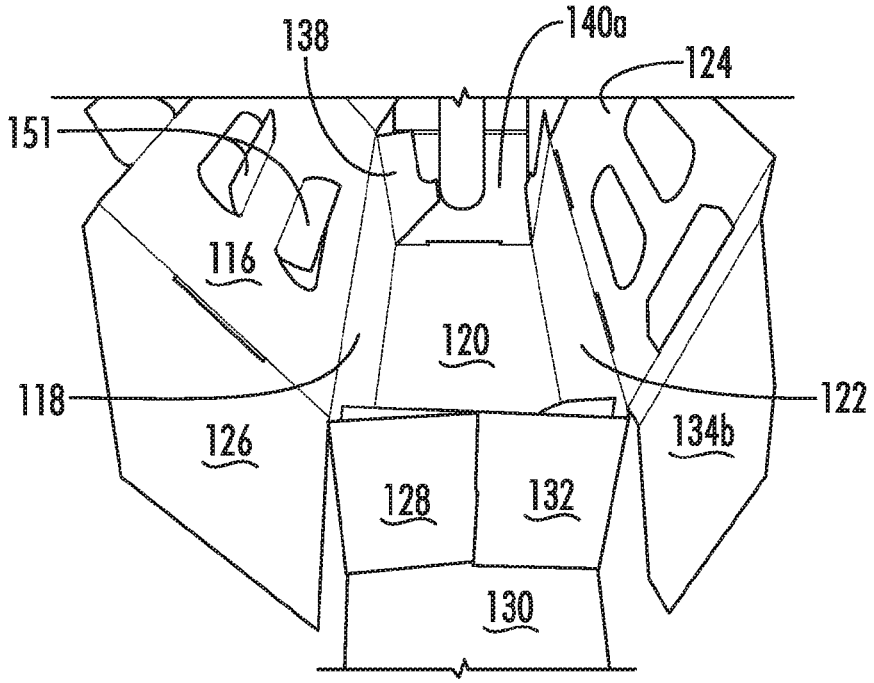
FIGS. 3*b-c* are perspective views illustrating the assembly of the beverage container from the blank of FIG. 2.
Figure 3C:
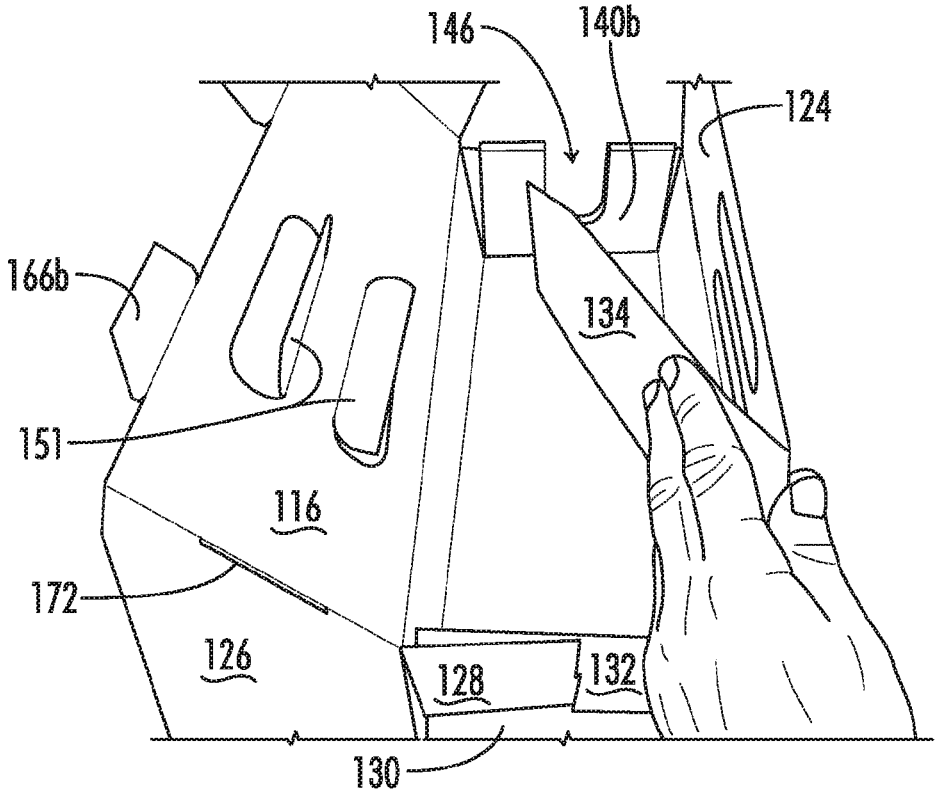

FIG. 2 illustrates a blank utilized to create the beverage container of FIG. 3. Although typical blank material is paperboard, numerous other similar foldable materials are suitable including formed pulp paper, bagasse, and microflute or other corrugated board material. The blank 108 has five principal panels, 116, 118, 120, 122, and 124 separated by fold lines. At the lower end of each principal panel is a bottom flap, 126, 128, 130, 132 and 134 respectively. Top flaps 136, 138, 140, and 142 are attached by fold lines to the first four of the panels. Slots 170, 171, and 172 are placed on or adjacent to fold lines to mate with tabs 166, 167, and 168 respectively when the blank is folded into its container shape. When assembled, as reflected in the sectional view of FIG. 3*a*, the center bottom panel 130 is on the bottom and the right top panel 136 is on the top and mouth 107 of bag 105 extends through slot 146 and aperture 148 to communicate a contents of bag 105 to the outside of the container 110. FIG. 3*b* shows that in assembling the blank 108 to form the container 110 the center panel 120 can rest on the surface while adjacent panels 118 and 122 are positioned vertically at approximately 90 degree angles to center panel 120 and bottom flaps 128 and 132 are interlocked with their notches 161, 162. Then top flaps 138, 142 are folded to a position perpendicular with their respective panels, 118, 122. Slotted top flap 140 is folded over flaps 138, 142 so that a portion 140*a* is above and distal portion 140*b* is below, those top side flaps. It can be seen that the contours of top side flaps 138, 142 are cut to match the shape of slot 146 and flap 140 is folded along fold line 145. Then protective flap 134 is folded inward along fold line 125 to a position adjacent to openings 150 and bag 5 is placed within the container with its neck 107 fitting in the slot 146. Right panel 124 is closed over the bag to a position parallel to center panel 120 and left panel 116 is folded over on top of panel 124 and tabs 166*a*, 166*b* are inserted in slots 170 to secure the peripheral structure of container 110. Then flap 126 is folded beneath the base formed by notched flaps 128, 132 and center flap 130 is folded on top of flap 126 and tab 167 is inserted in slot 172 to secure the base of container 110. Finally, top flap 136 is folded over the neck of bag 105 so that it extends through opening 148 which restrains the position of the neck within slot 146. Tab 168 is inserted into slot 171 to secure the top structure of container 110. The opening 158 in panel 124 allows tab 167 is pass through slot 172 and not be interfered with by a portion of panel 124. The container 110 is gripped through opening 154 where segments 151 are held along fold line 152 and fold downward through openings 150 and panel 124 and against the protective panel 134 that is interposed between bag 105 and the handle area.

Figure 4:
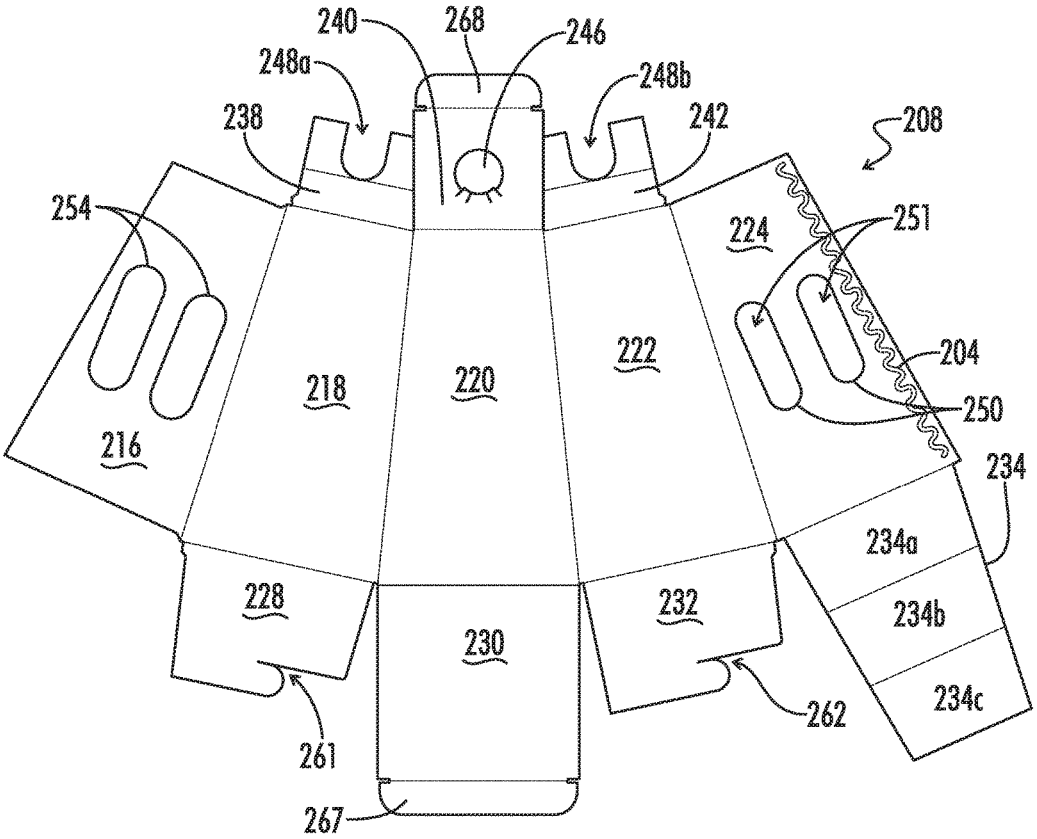
FIG. 4 is a bottom plan view of an alternative blank from which an outer shell of an improved beverage container is constructed.
Figure 5A:
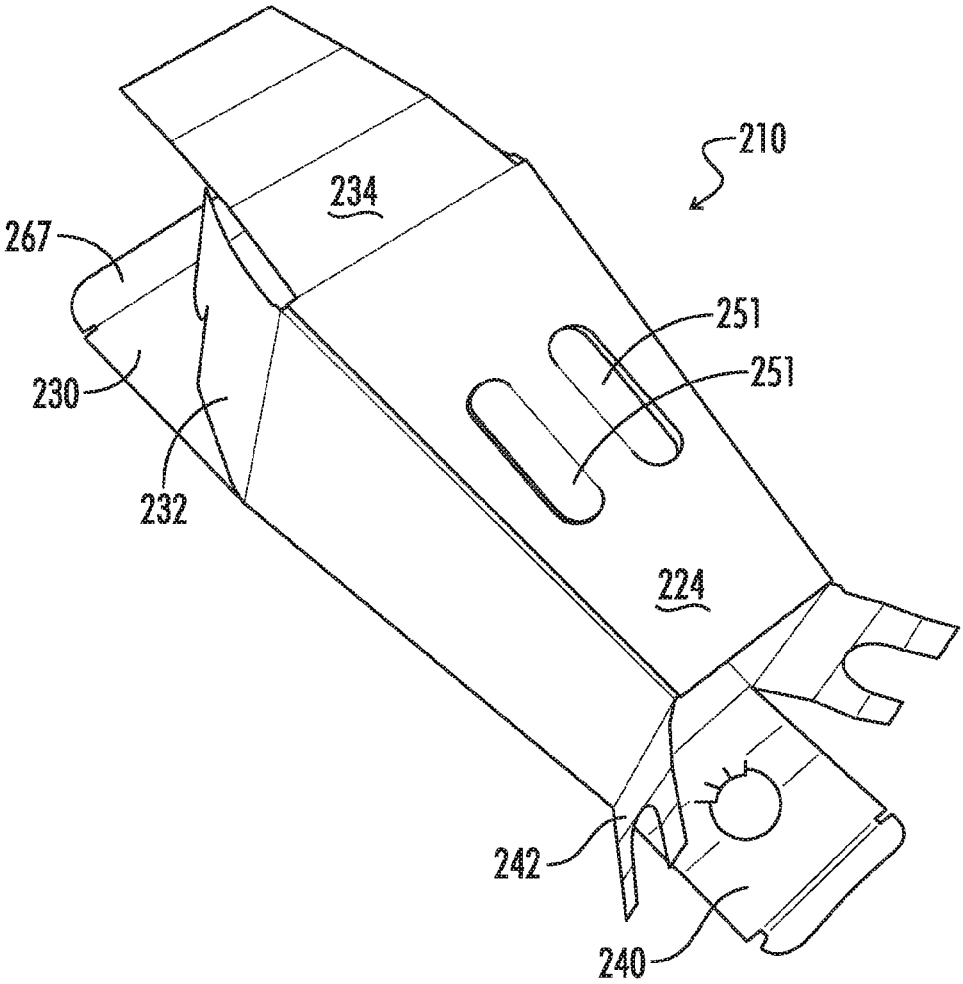
FIG. 5*a* is a perspective view illustrating the construction of the beverage container from the blank of FIG. 4.

FIG. 4 shows an alternative blank 208 with five body panels 216, 218, 220, 222 and 224 is assembled in a similar fashion to the blank of FIG. 2. However, with the blank 208 of FIG. 4, after forming the three sided container with its central panel 220 and adjacent panels 218, 222 extending at a 90 degree angle to central panel 220, left panel 216 is folded over and right panel 224 is attached by adhesive 204 to panel 216. In this fashion, the general shape of the container 210 is formed as shown in FIG. 5*a*. Then the container is completed by folding protective flap 234 inward to adjacent panel 224, by interlocking bottom flaps 228, 232 with notches 261 and 262, and by folding center bottom flap 230 across the bottom and inserting tab 267. Then a bag, such as 105 shown in FIG. 3*a*, is inserted into the top of the box and the neck is captured in slots 248*a*, 248*b* as top flaps 238, 242 are folded downward. Finally, top center flap 240 is closed on top of the mouth 107 of bag 105 and tab 268 inserted within the edge of the container 210.

Figure 6A:
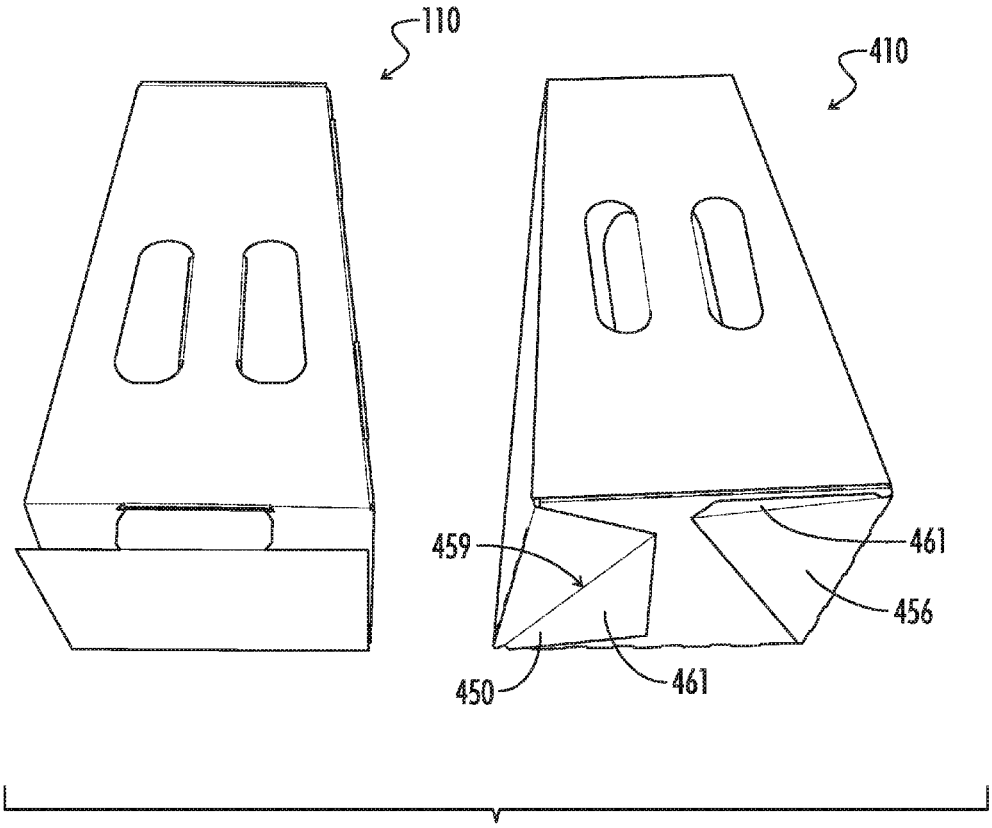
FIG. 6*a* is a comparison of assembled containers with tabbed and adhesive closures on the base.
Figure 6B:
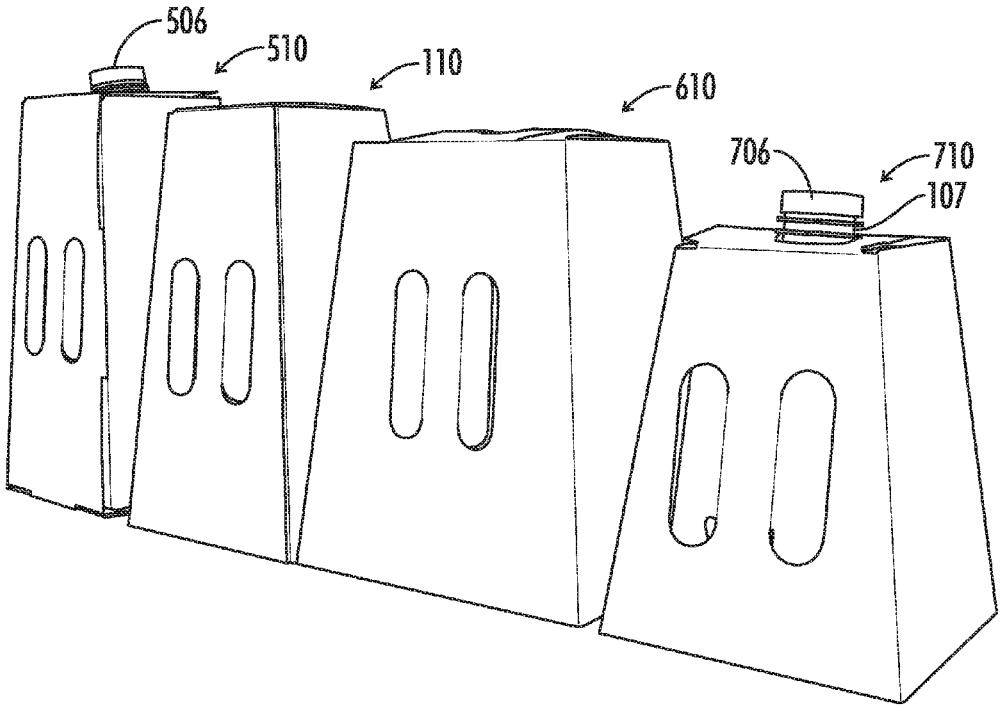
FIG. 6*b* is a comparison of different height containers.
Figure 9:
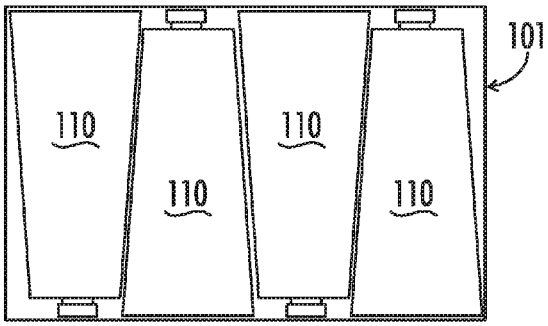
FIG. 9 is a perspective view of a bulk container for shipping a plurality of the beverage containers assembled from blanks similar to those disclosed in FIGS. 2 and 4 with flexible bags mounted therein.

Many other variations are possible, including a glued box assembly similar to that described in FIG. 1. In FIG. 6*a*, box 410 has a bottom with bottom flap fold lines 459, where a section 461 of bottom panels 450, 456 is glued to form a relatively permanent structure. FIG. 6*b* shows a variety of sizes of containers 510, 110, 610 and 710, showing that containers may be optimized for packing in standard box sizes as shown in FIG. 9. Containers 510 and 710 show the mouth 107 extending from the container and being closed with cap 706, 506.

Figure 7:
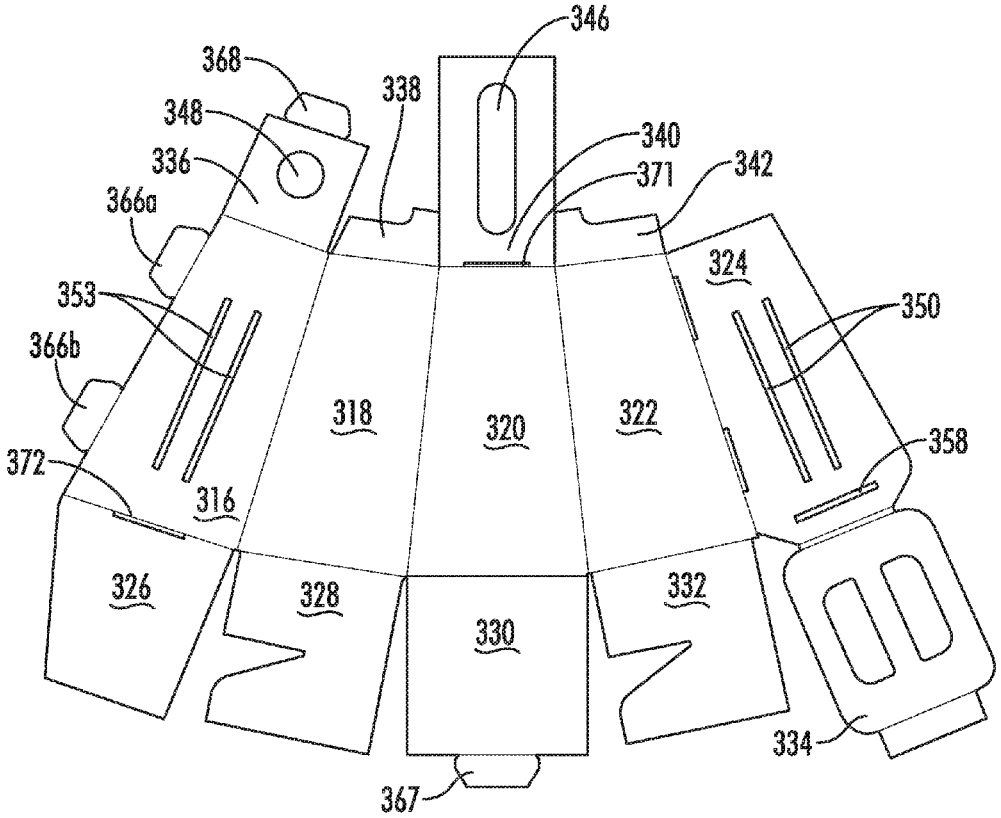
FIG. 7 is a bottom plan view of an alternative blank from which an outer shell of an improved beverage container is constructed.
Figure 8A:
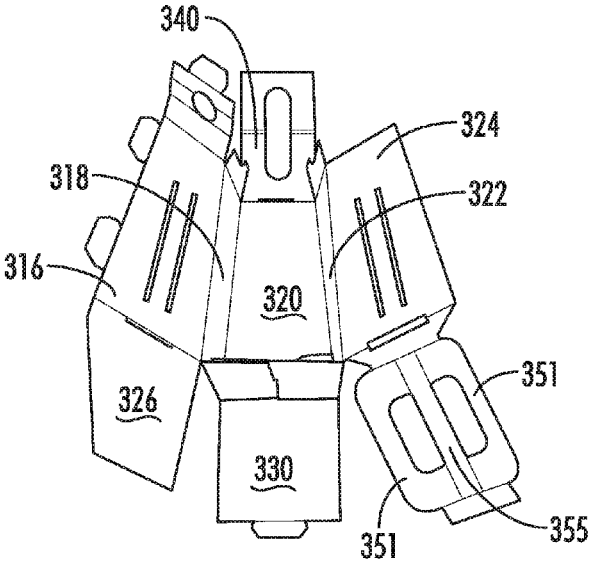
FIGS. 8*a-e* are perspective views illustrating the assembly of the beverage container from the blank of FIG. 7.
Figure 8B:
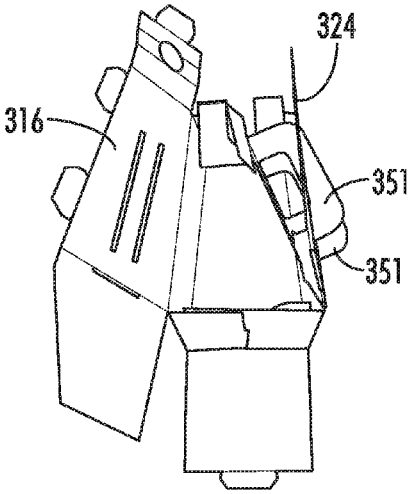
Figure 8C:
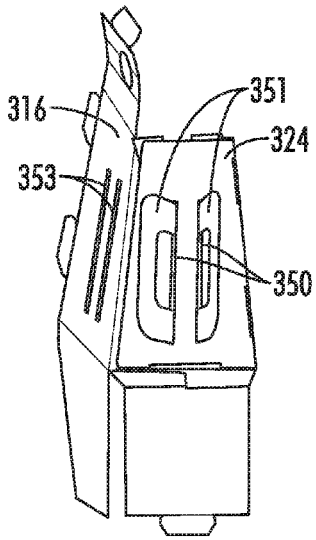
Figure 8D:
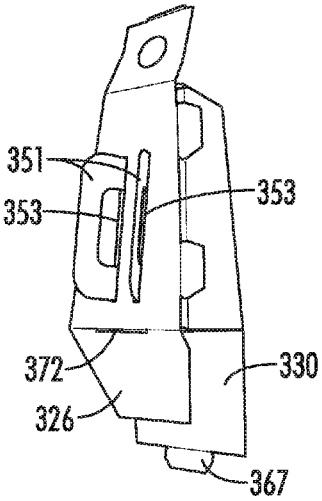
Figure 8E:
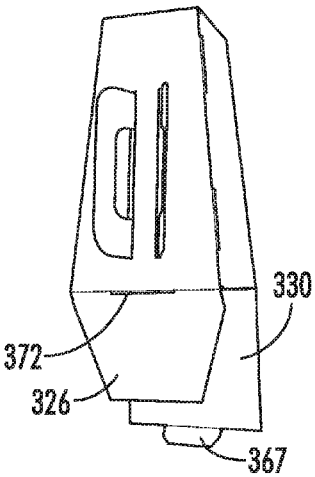

FIG. 7 illustrates a blank 308 similar to the blank of FIG. 2, however configured to create a handle 351 that extends outward from the resulting container 310 as shown in FIG. 8*f*. The principal distinction from blank 108 is that the left panel 316 has two slots 353 and the right panel 324 has two slots 350. In addition, rather than a protective panel 134, right panel 324 has a handle forming panel 334. Thus, it can be seen in FIG. 8*a*, when the sidewalls are formed by vertically positioning panels 318, 322, the bottom flap of right panel 324 is the handle panel 334 with D-shaped handle components 351 on either side of center 355. As reflected in FIG. 8*b*, the handle portions are inserted through slots 350 and panel 324 is closed the fourth wall of the container. Then panel 316 is placed on top with handles 351 passing through slots 353 as reflected in FIGS. 8*c* and 8*d*. Finally left bottom flap 326 is closed on the base and center bottom flap 330 is closed with tab 367 interfitting in slot 372.

Figure 10A:
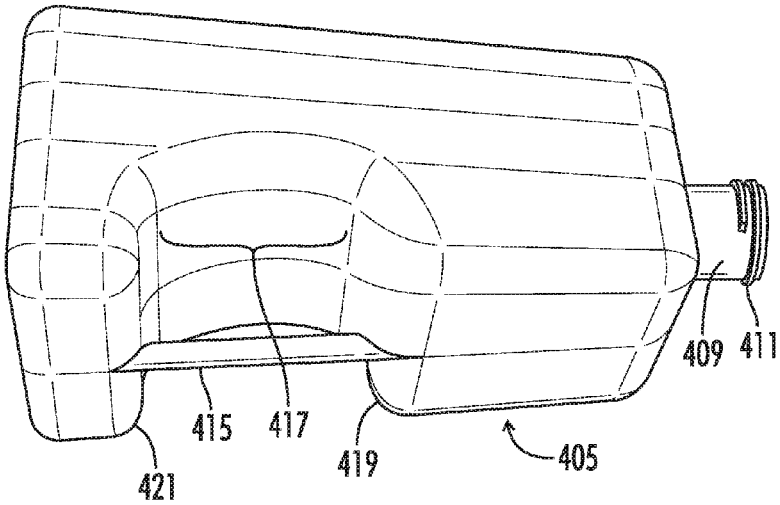
FIG. 10A is a perspective view of an exemplary plastic carton that may be disposed within the container.

If a vendor is receptive to using preassembled containers, there is no reason that a flexible bag is required to hold the liquid in the container. Since the containers no longer have to be collapsed, a relatively rigid, and non-collapsible carton can be disposed within the preassembled container. FIG. 10A is a perspective view of an exemplary plastic carton 405 that may be disposed within the container, typically made of HDPE or similar material. The carton 405 will have a neck portion 409 preferably with threaded section 411 near the mouth to engage with a cap and providing access to pour liquid into the container. An optimized container configuration has upper shoulder 419 and lower shoulder 421 about a handle recess 417 which is bridged by gripping bar 415 in the illustrated embodiment.

Figure 10B:
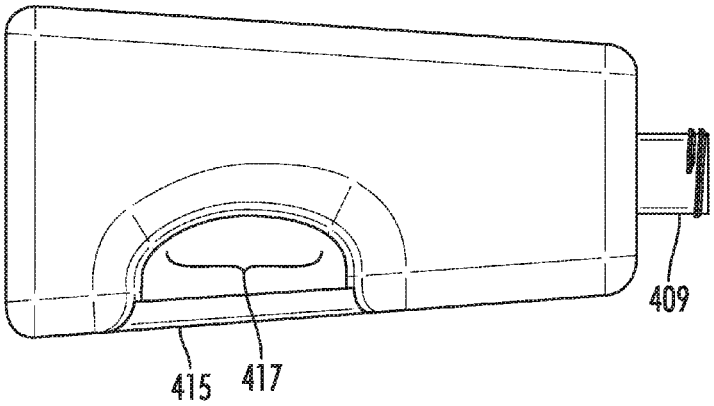
FIG. 10B is a side plan view of the carton of FIG. 10A, showing the top cylindrical opening, a hollow body with an arcuate recess and a gripping bar extending across the recess.

FIG. 10*b* is a side plan view of the carton 405 showing the cylindrical spout 409 with opening allowing access to the hollow body with arcuate recess 417 and gripping bar 415 extending across the recess.

Figure 10C:
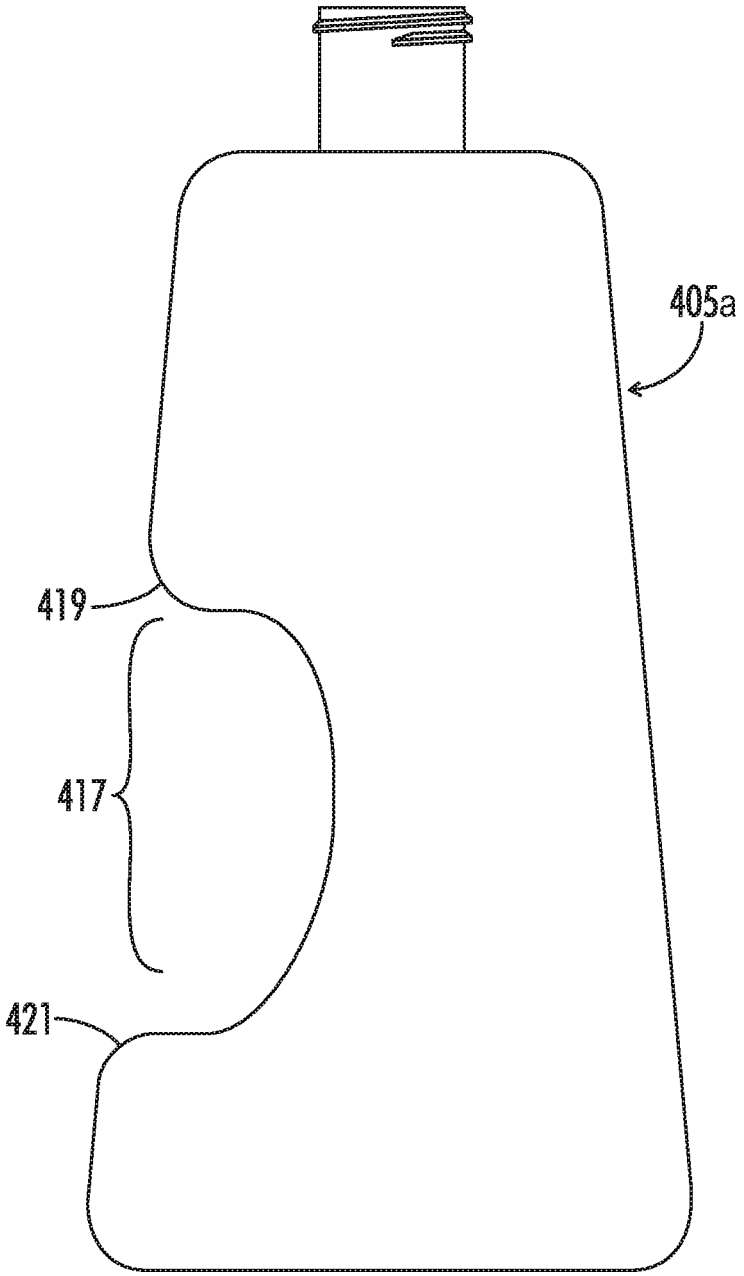
FIG. 10C is a schematic drawing of a carton with no gripping bar.

FIG. 10C is a schematic drawing of a carton 405*a* with no gripping bar, but the recess 417 still being provided to the facilitate gripping through the outer box structure and with the box structure serving as a carrying handle.

Figure 11A:
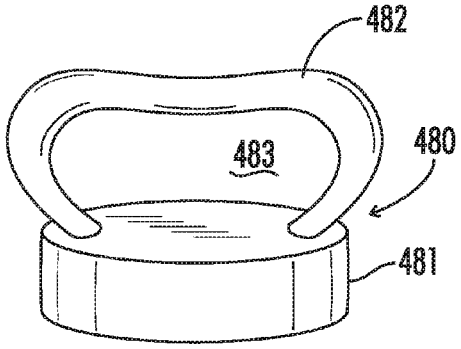
FIG. 11A is an exemplary top for a carton with a loop handle structure.
Figure 11B:
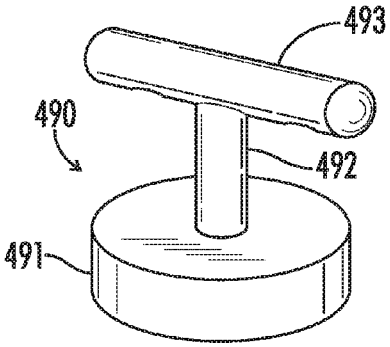
FIG. 11B is an exemplary top for a carton with a T-handle structure.

The use of a relatively rigid carton to hold the liquid also allows that carton structure to assist with managing the handling of the container. Not only can gripping bar 415 be utilized on the container for handling when pouring, but a cap or lid attached to threads 411 may also facilitate upright carriage of the carton and liquid. FIG. 11A is an exemplary cap 480 for a carton with a loop handle 482 attached to lid 481 defining an opening 483. The cap 480 can be screwed on at the threaded cylindrical mouth 409 of the plastic carton 405 after filling the carton 405 and the loop 482 provides a convenient, and relatively insulated, handle or grasping portion for carrying the filled container. FIG. 11B is an alternative exemplary cap 490 for a carton with a T-handle structure where post 492 protrudes from lid 491 and crossbar 493 across the post 492 forms a handle that is readily grasped.

Figure 12:
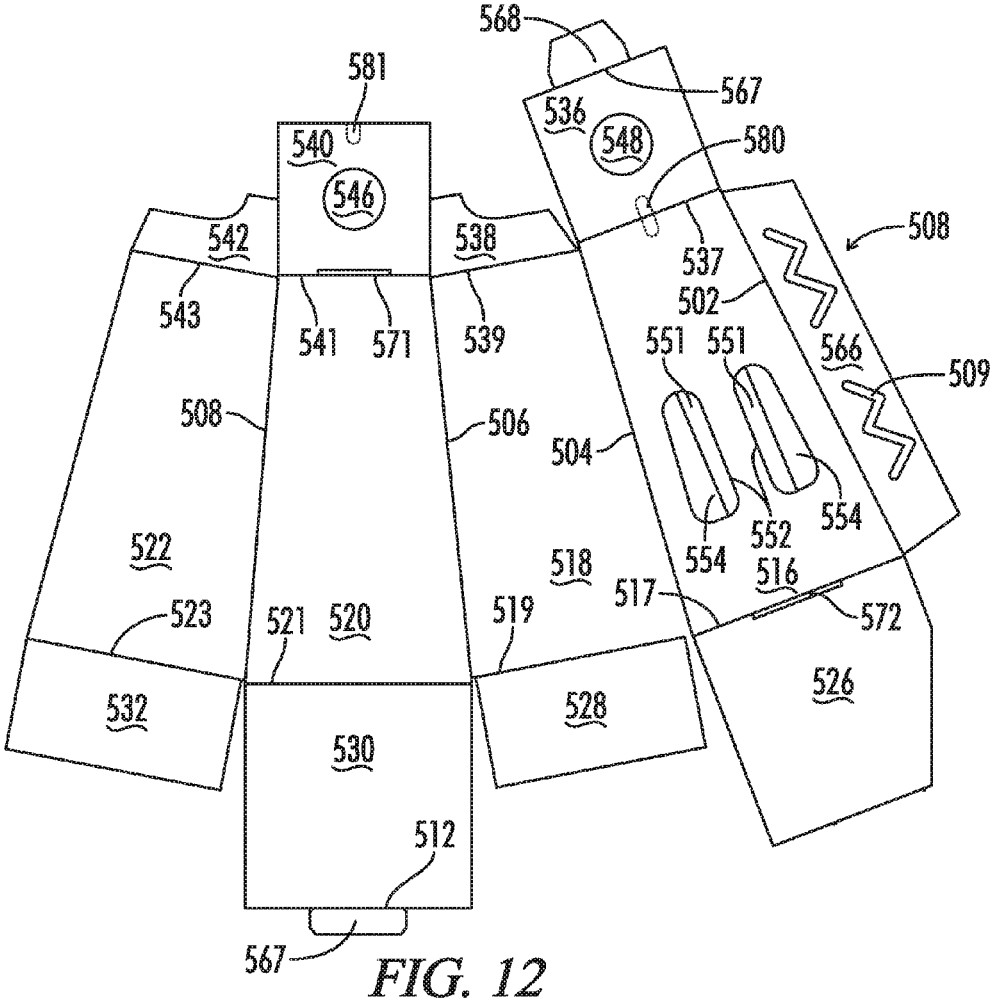
FIG. 12 is the exterior of an exemplary blank for use when the container will be preassembled and glued, with cuts for a viewport shown in phantom.

FIG. 12 is the exterior of an exemplary blank 508 for use when the container will be preassembled and glued. In this blank 508, there is no need for many of the tabs shown in alternative blanks because the blank will be glued together before shipment to the retailer. The blank 508 has four principal body panels 516,518,520 and an attachment or glue panel 522 separated by fold lines, 504,506,508, and 502. The principal body panels are preferably in the shape of isosceles trapezoids, with upper edges relatively shorter and parallel to lower edges, but other trapezoidal shapes are possible. At the lower end of each principal body panel is a bottom flap, 526,528,530,532 respectively. Top flaps 536, 538,540 and 542 are attached by fold lines 537,539,541 and 543 to the principal panels. Slots 571 and 572 are placed on or adjacent to fold lines to mate with tabs 568,567 respectively when the blank is folded into its container shape.

Figure 13:
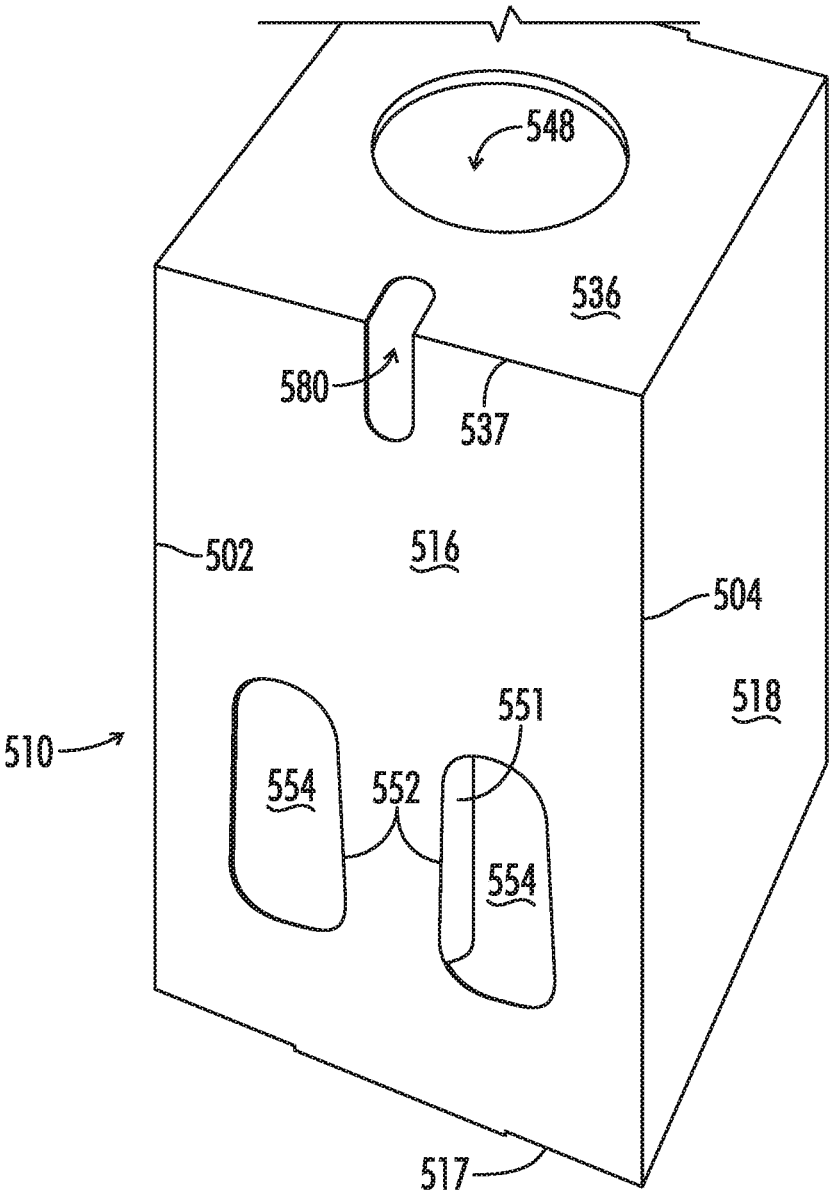
FIG. 13 is a perspective view of the container assembled from the blank of FIG. 12 with the view port.

When assembled as reflected in FIG. 13, the center bottom panel 530 is on the bottom and the right top panel 536 is on the top and the neck 409 of carton 405 extends through space between top flaps 538,542 and openings 546 and 548 in top flaps 536,540 to communicate interior of carton 405 to the exterior of the container 510. Bottom flaps 526,528,530,532 are folded along lines 517,519,521 and 523, typically so that half panels 528,532 are adjacent the carton 405 and then covered by panel 526 and finally locked in place by panel 530 and the insertion of tab 567 into slot 572. Alternatively, bottom flaps may be glued in place. The pyramidal body formed of four principal panels, 516,518, 520,522 is held in place by glue or other adhesive 504 on attachment panel 566 that attaches to the interior of panel 522. In order to facilitate grasping the carton 510, two openings 554 are provided in body panel 516, formed by folding ovals 551 along fold lines 552 toward the interior of the carton. Preferably the carton 405 inside the box has a grasping bar 415 that is located between the openings 554 to allow easy manipulation of the container 510 for pouring of liquids from the carton. Shown in phantom are opening 580 and slot 581 which may be cut from blank 508 to provide for a viewport 580 shown in FIG. 13. When carton 405 is within container 510, viewport 580 allows a user to view the top portion of and determine the fill level of carton 405 and prevent accidental spills.

Figure 14:
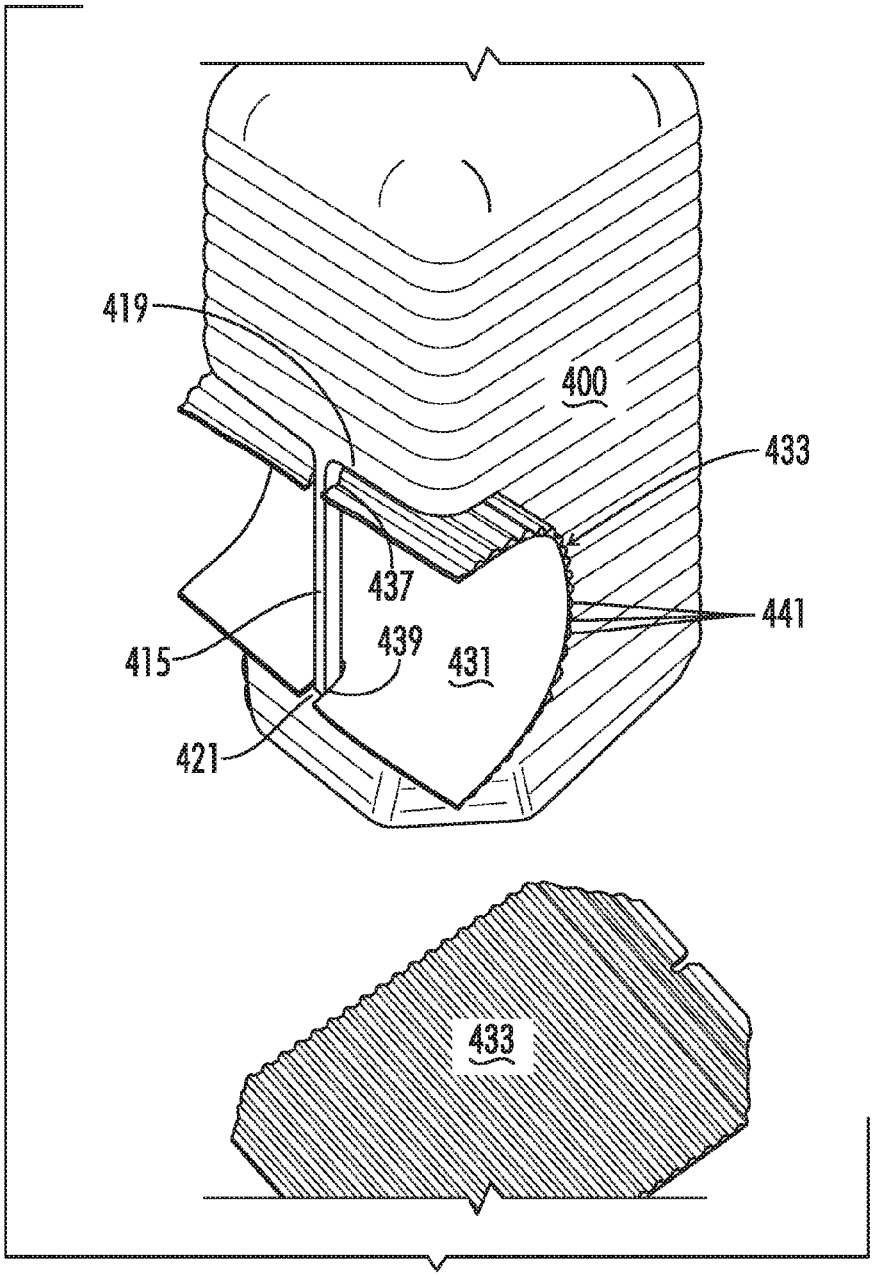
FIG. 14 is a perspective view of a plastic carton for use with the container of FIG. 13 showing an insulating panel.

FIG. 14 illustrates the use of a cardboard blank 433 with notches 437,439 to fit within the handle recess 417 of carton 405. The notches 437,439 are utilized to secure the heat shield 433 on the gripping bar 415 extending across the handle recess of the carton. The illustrated heat shield 433 is made of corrugated board having a backing sheet 431 with air filled corrugations 441 helping to space the backing sheet 431 away from the carton 405 and providing an insulating layer of air. It will be understood that foams and other insulating materials can suitably be utilized in place of corrugated board.

All publications, patents and patent documents are incorporated by reference herein as though individually incorporated by reference.

Although preferred embodiments of the present invention have been disclosed in detail herein, it will be understood that various substitutions and modifications may be made to the disclosed embodiment described herein without departing from the scope and spirit of the present invention as recited in the appended claims.

We claim:

1. A container blank of foldable material adapted to encase a carton of liquid comprising:

(a) a rear trapezoidal body panel having a fold line along an upper edge attached to a proximal edge of a rectangular rear top flap with a fold line at its distal edge attached to a tab;

a fold line with a slot, along a lower edge that is relatively longer than the upper edge, attached to a proximal edge of a rear bottom flap;

a fold line along a right edge attached to an attachment panel;

a fold line along a left edge attached to left side trapezoidal body panel;

(b) said left side trapezoidal body panel having a fold line along an upper edge attached to a proximal edge of a left top flap;

a fold line along a lower edge that is relatively longer than the upper edge, attached to a proximal edge of a left bottom flap;

a fold line along a left edge attached to front trapezoidal body panel;

(c) said front trapezoidal body panel having a fold line with a slot along an upper edge attached to a proximal edge of a rectangular front top flap;

a fold line along a lower edge that is relatively longer than the upper edge, attached to a proximal edge of a rectangular front bottom flap with a fold line at its distal edge attached to a tab;

a fold line along a left edge attached to right side trapezoidal body panel;

(d) said right side trapezoidal body panel having a fold line along an upper edge attached to a proximal edge of a right top flap;

a fold line along a lower edge that is relatively longer than the upper edge, attached to a proximal edge of a right bottom flap;

(e) wherein the rectangular rear top flap has an opening therein to receive the spout of a carton.

2. The container blank of claim 1 wherein the rectangular front top flap has an opening therein to receive the spout of a carton.

3. The container blank of claim 1 wherein the rear, left side, front, and right side body panels are isosceles trapezoids.

4. The container blank of claim 1 wherein the rectangular rear top flap is square.

5. The container blank of claim 1 wherein the rectangular front top flap is square.

6. The container blank of claim 1 wherein the rectangular front bottom flap is square.

7. The container blank of claim 1 wherein the left top flap and the right top flap have portions that are less than half the length of the rear trapezoidal body panel upper edge.

8. The container blank of claim 1 wherein the rear body panel has two ovals with adjacent fold lines and distal cut lines.

9. The container blank of claim 1 wherein one of the rear, left side, front, or right side body panels has an opening extending downward from the fold line along the upper edge.

10. The container blank of claim 9 wherein the opening on the body panel extends upward across the fold line to the attached top flap.

11. The container blank of claim 1 wherein the attachment panel is relatively smaller than the rear, left side, front, and right side body panels.

12. The container blank of claim 1 wherein the foldable material is selected from the group of paperboard, corrugated board, bagasse paper, and microflute corrugated board.

13. A method of forming a box of foldable material encasing a carton for holding fluid comprising the steps of:

forming a blank of foldable material having (a) a rear trapezoidal body panel having a fold line along an upper edge attached to a proximal edge of a rectangular rear top flap with a fold line at its distal edge attached to a tab;

a fold line with a slot, along a lower edge that is relatively longer than the upper edge, attached to a proximal edge of a rear bottom flap;

a fold line along a right edge attached to an attachment panel having a relatively smaller size than the trapezoidal body panel;

a fold line along a left edge attached to left side trapezoidal body panel;

(b) said left side trapezoidal body panel having a fold line along an upper edge attached to a proximal edge of a left top flap;

a fold line along a lower edge that is relatively longer than the upper edge, attached to a proximal edge of a left bottom flap;

a fold line along a left edge attached to front trapezoidal body panel;

(c) said front trapezoidal body panel having a fold line with a slot along an upper edge attached to a proximal edge of a rectangular front top flap;

a fold line along a lower edge that is relatively longer than the upper edge, attached to a proximal edge of a rectangular front bottom flap with a fold line at its distal edge attached to a tab;

a fold line along a left edge attached to right side trapezoidal body panel;

(d) said right side trapezoidal body panel having a fold line along an upper edge attached to a proximal edge of a right top flap;

a fold line along a lower edge that is relatively longer than the upper edge, attached to a proximal edge of a right bottom flap;

(e) wherein the rectangular rear top flap has an opening therein to receive the spout of a carton;

folding the fold lines between the rear, left side, front, and right side body panels and attachment panel to create an open-ended chamber, placing adhesive on the attachment panel and attaching said attachment panel to the right side body panel;

folding the left and right top flaps across the top of the open ended chamber, folding the front top flap across the left and right top flap, and folding the rear top flap across the front top flap to close the smaller end of the open ended chamber;

and inserting a carton for holding fluids having a mouth in said chamber so that the mouth extends from the opening in the rear top flap across the smaller end of the open ended chamber adjacent to upper edges of the body panels;

folding the right and left bottom flaps across the larger end of the open ended chamber, folding the rear bottom panel across the right and left bottom flaps, and folding the front bottom flap across the rear bottom flap.

14. The method of claim 13 wherein the mouth has a distal threaded portion external of the chamber having a cap thereon.

15. The method of claim 13 further comprising forming an opening in a trapezoidal body panel.

16. The method of claim 13 wherein a grip bar on the carton is accessible through the opening in a trapezoidal body panel.

17. The method of claim 13 wherein a trapezoidal body panel has an opening and handles are extended through said opening.

18. The method of claim 13 wherein the carton is visible through an opening extending from a fold line along the upper edge of a body panel.

19. The method of claim 13 further comprising inserting a tab attached to the rear top flap into the slot on the fold line along the upper edge of the front body panel to secure the top flaps.

20. The method of claim 13 further comprising inserting a tab attached to the front bottom flap into the slot on the fold line along the lower edge of the rear body panel to secure the bottom flaps.

* * * * *